United States Patent [19]

Pilié et al.

[11] 4,136,010

[45] Jan. 23, 1979

[54] CATCH BASIN INTERCEPTOR

[75] Inventors: Roland J. Pilié, Williamsville; Douglas B. Dahm, Lake View, both of N.Y.

[73] Assignee: Calspan Corporation, Buffalo, N.Y.

[21] Appl. No.: 893,905

[22] Filed: Apr. 5, 1978

[51] Int. Cl.[2] ..... E03F 5/06; E03F 5/14

[52] U.S. Cl. ..... 210/164; 52/20; 404/25

[58] Field of Search ..... 210/164, 535, 170, 166; 404/2, 4, 25, 26; 52/19, 20, 21

[56] References Cited

U.S. PATENT DOCUMENTS

| | | | |
|---|---|---|---|
| 942,907 | 12/1909 | Huff | 210/535 |
| 1,844,443 | 2/1932 | Schmidt | 210/164 X |
| 3,567,024 | 3/1971 | McCormick | 210/164 |

OTHER PUBLICATIONS

"Pollution Control at MIA", *Airport World* Feb., 1974.

*Primary Examiner*—Charles N. Hart
*Assistant Examiner*—E. Rollins Cross
*Attorney, Agent, or Firm*—Allen J. Jaffe; David J. Zobkiw

[57] ABSTRACT

A catch basin may be retrofit for isolating/diverting spills and/or initial storm runoff for the subsequent treatment or recycling of the collected material. A sloping, peripheral trough is provided in the catch basin and is connected to one or more storage or recovery tanks or the like. A plurality of catch basins may be provided with troughs connected to one or more common storage or recovery tanks.

7 Claims, 5 Drawing Figures

CATCH BASIN INTERCEPTOR

Surface drainage into catch basins frequently contains contaminants which are harmful to the environment and it is desirable that they be intercepted and discharged into holding or treatment facilities. For example, water entering storm drains at major airports may include: (1) spills of oil and fuel that flow over the ramp surfaces into catch basins; (2) the flow of deicing solutions (ethylene glycol, water and additives) over the surface into catch basins; and (3) the flow of storm runoff, particularly initial storm runoff, which dislodges industrial pollutants from ramp areas and carries them into catch basins. It is readily apparent that there are advantages in intercepting and treating these materials rather than discharging them into a nearby body of water via the storm sewer system.

The only complete solution to pollution originating at the ramp (or other) surface is to direct all ramp runoff to a treatment system before discharging it to adjacent waters. However, a one inch rainfall amounts to over ten million gallons of runoff from passenger terminal ramp areas alone at major airports. Since short term rainfall rates in excess of two inches per hour are not uncommon, it is obviously impractical to treat all ramp runoff. An interceptor system is required to direct the most polluted runoff, including spills, to appropriate treatment systems while permitting less contaminated storm runoff, over and above the capacity of the treatment systems, to enter the existing storm drains.

The general field of this invention is the interception of runoff water and other liquid materials at catch basins, floor drains and other sumps. Interception is accomplished in such a way as to permit excess liquid, beyond the capacity of the receiving system for intercepted liquid, to be directed automatically into a separate drainage system which may exist prior to installation of the interceptor. The drain system of the interceptor is such that two or more receiving systems for intercepted liquids may be installed and specific liquids may be directed to a selected receiving system by manually operated valves.

It is an object of this invention to provide an interceptor for installation in existing catch basins.

It is an additional object of this invention to provide a system for the recovery of spilled materials.

It is a further object of this invention to provide an interceptor for spillage and pollutants that permits excess influent to automatically enter the existing drainage system to prevent surface flooding where the existing drainage system is adequate. These objects, and others as will become apparent hereinafter, are accomplished by the present invention.

Basically, the present invention is directed to a trough for installation around the inner periphery of a conventional catch basin. The troughs from one or more catch basins can be connected to one or more appropriate retention/treatment systems. Excess flow enters the existing drainage system by spilling over the inner wall of the trough. The drain pipes receiving intercepted runoff may be installed inside of existing large diameter pipes or by using conventional underground techniques with the receiving pipe passing through the catch basin wall.

For large installations where various solvents are used, such as aircraft deicing ramps, large retention tanks can be used to hold selected waste material for recycling. These may be installed underground near the catch basins in which the troughs are used and attached to the trough gravity drain pipes. Alternatively, a sump with associated pump may be attached to the selected branch of the trough drain and intercepted material pumped directly into a tank truck or permanent retention tank installed above ground.

When used to intercept spilled material such as oil or fuel, an inflatable bladder may be installed in the second branch of the trough drain. This bladder can be stored in the catch basin in the deflated configuration, with the valve between it and the trough closed. In the event of a spill the valve in that branch could be opened and the normally open valve in the drain line closed. Spilled material can thereby be trapped.

BRIEF DESCRIPTION OF THE DRAWINGS

For a fuller understanding of the present invention, reference should now be had to the following detailed description thereof taken in conjunction with the accompanying drawings wherein.

DESCRIPTION OF THE PREFERRED EMBODIMENT

Figure 1:
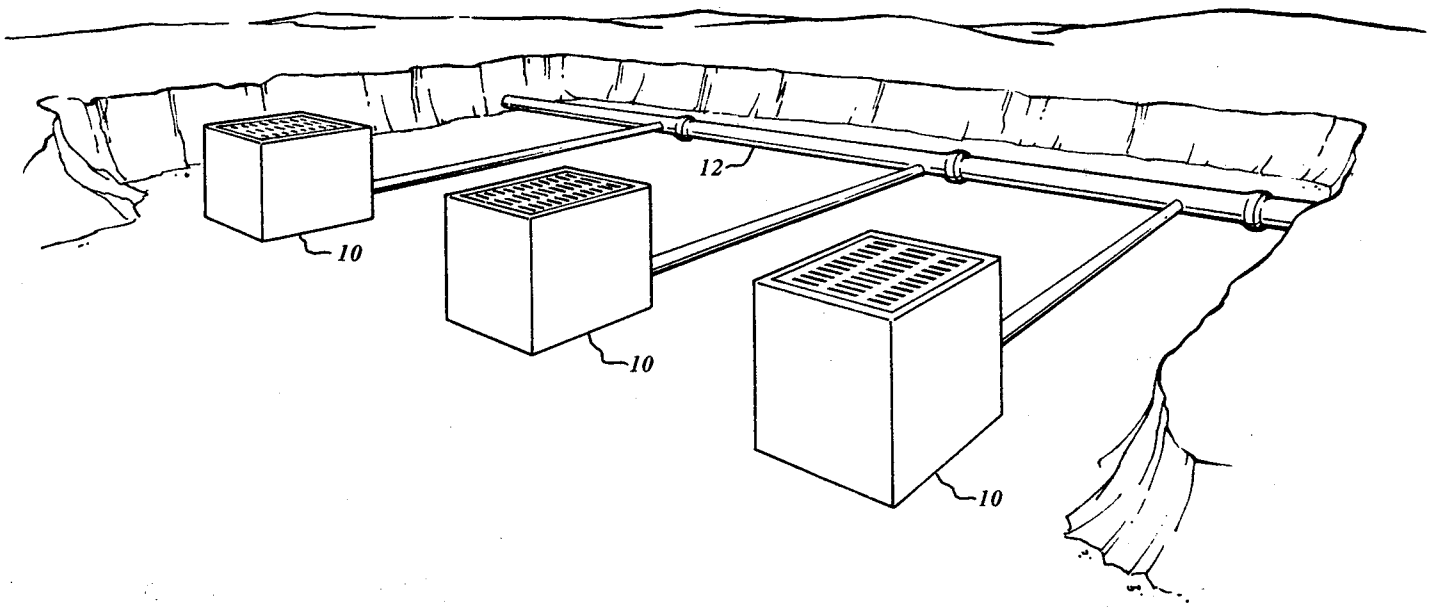
FIG. 1 is a diagramatic representation of a portion of a storm sewer system.

In FIG. 1, the numeral 10 designates each of a plurality of conventional catch basins which are located in a drainage area and are connected to storm sewer 12. All runoff and spills entering the catch basins 10 are directed into the storm sewer 12.

Figure 2:
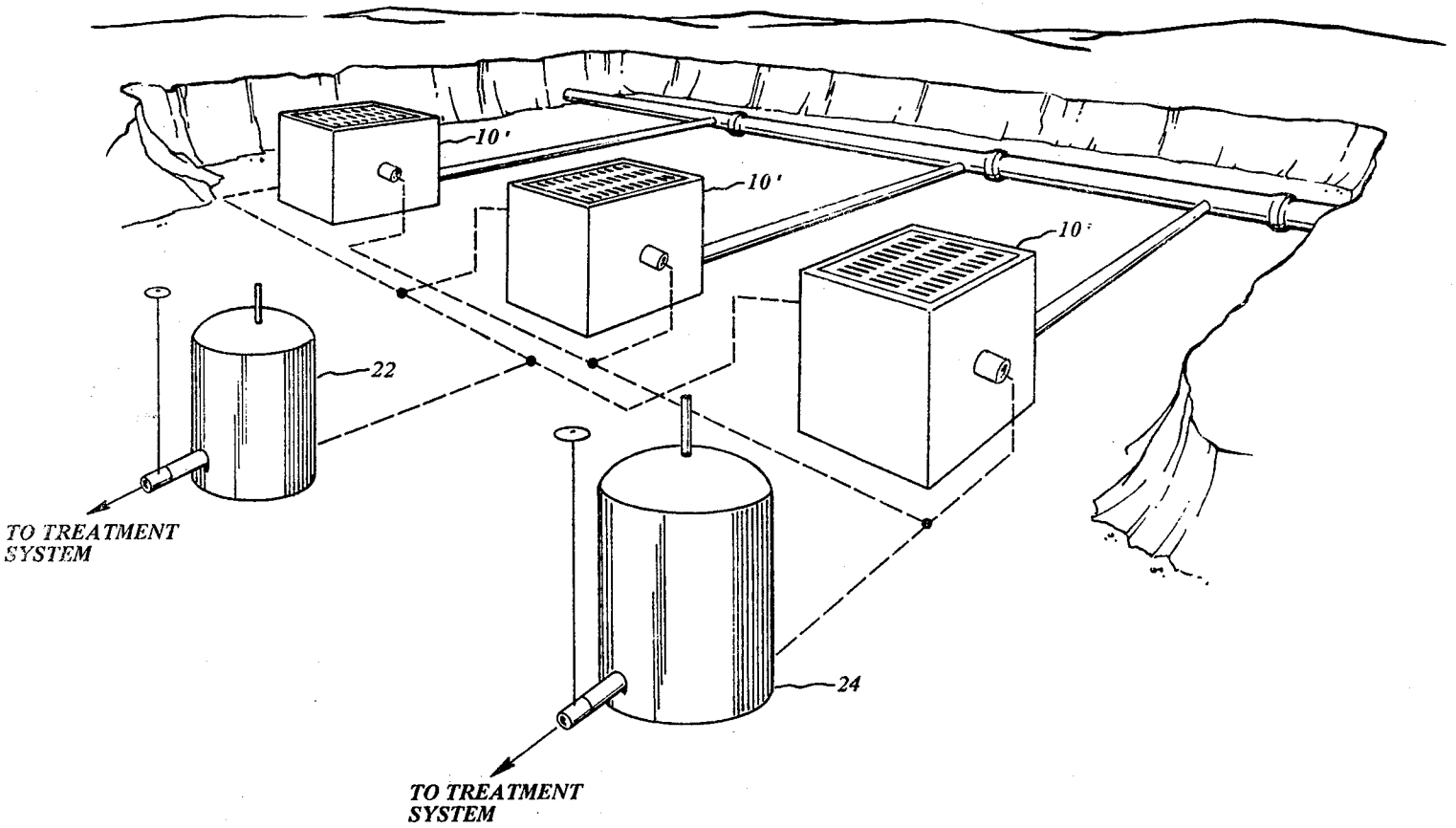
FIG. 2 is a diagramatic representation of the storm sewer system of FIG. 1 modified to incorporate the present invention.

When the storm sewer system of FIG. 1 is modified by the addition of the present invention the system of FIG. 2 results. With the interceptor trough of the present invention installed together with a recovery system, spilled material entering the catch basins 10' will be intercepted and diverted to recovery tank 22 and/or 24. As a result, spilled liquids are diverted from the storm sewer 12 to be retained for recycling or subsequent disposition in a safe manner.

Figure 3:
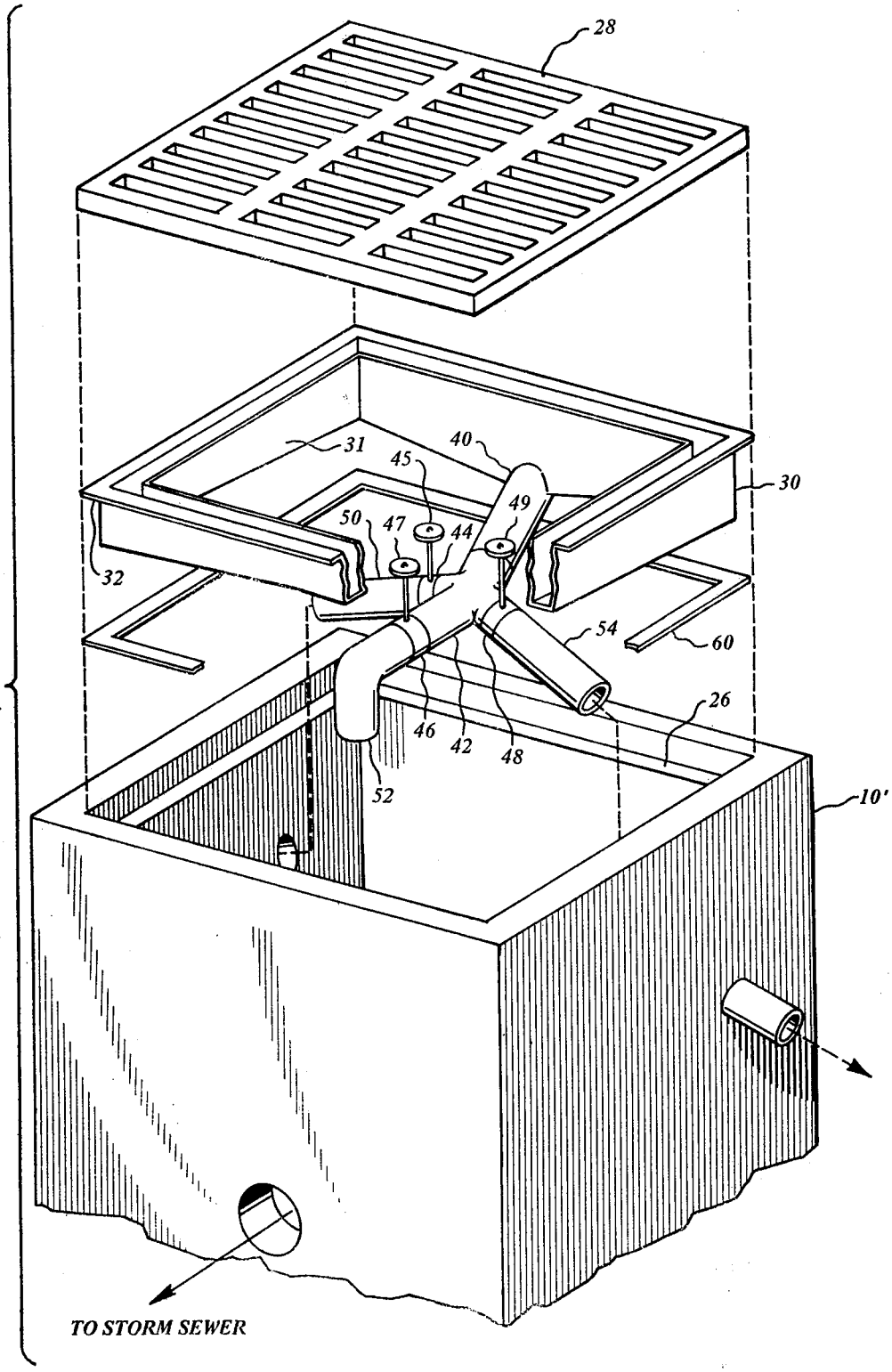
FIG. 3 is an exploded, partially cut away view of a catch basin having an interceptor.
Figure 4:
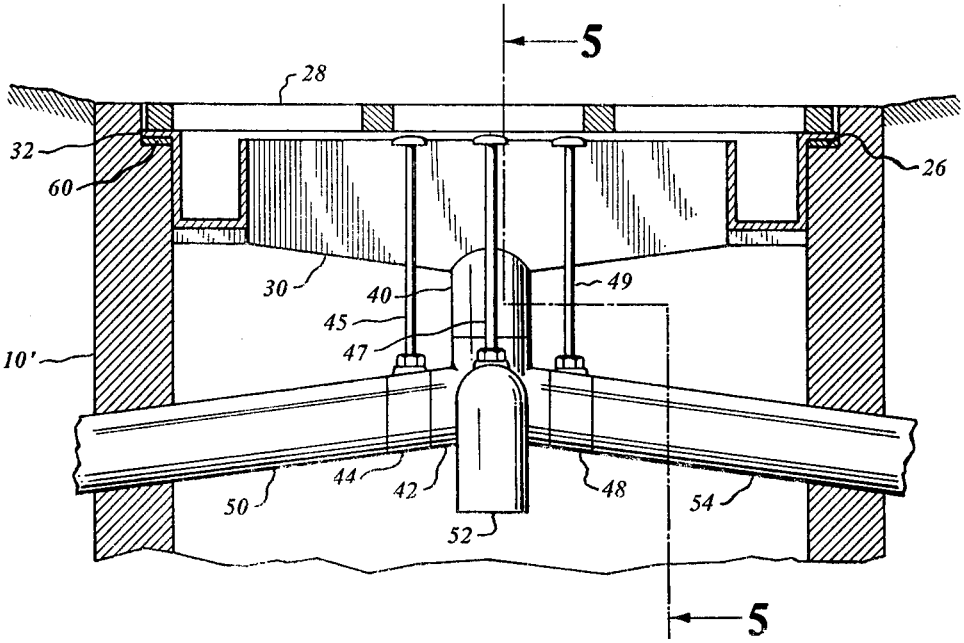
FIG. 4 is a sectional view taken along the axes of the diversion lines.
Figure 5:
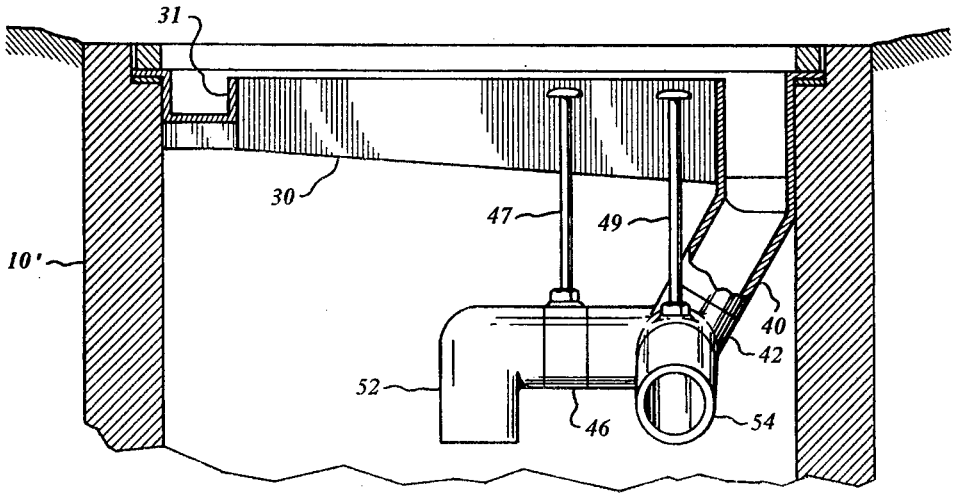
FIG. 5 is a sectional view taken along line 5—5 of FIG. 4.

In FIG. 3, the numeral 30 generally designates the interceptor which is in the form of an open rectangular trough approximately three inches wide and having a sloped bottom, thus causing the trough to range in depth from two to eight inches. The trough of interceptor 30 is dimensioned to fit inside catch basin 10' and to be supported in place by means of a peripheral lip 32 which rests on the ledge 26 of catch basin 10'. Ledge 26 is used to support grill 28 so that installation of the trough of interceptor 30 simply requires the removal of grill 28 and the cleaning of ledge 26. A precut gasket 60 would then be placed on the ledge 26 and the interceptor 30 dropped in place. The interceptor trough drain is made up of pipe 40 and branches 50, 52 and 54 which are connected via connection 42 and contain manually actuated valves 44, 46 and 48, respectively. Branches 50 and 54 would be connected to the appropriate receiving systems such as recovery tanks 22 and 24, respectively. Branch 52 would discharge into the catch basin 10' via normally open valve 46.

Because of the peripheral design and installation of the present invention, it provides ready access to the catch basin itself after the trough has been installed. This is important for maintenance of the catch basin and for attaching the drain pipe of the trough to all or any one of a number of receiving systems. Furthermore, without altering the basic invention, it is possible to attach additional receiving systems to the existing systems.

The sloping trough of interceptor 30 permits all of the trapped fluid to enter, typically, the 3-inch pipe 40 which discharges into one or more of the receiving systems via branches 50 and/or 54 or into catch basin 10' via branch 52. Long valve stems 45, 47 and 49 permit the operation of valves 44, 46 and 48, respectively, by keys inserted through the catch basin grill 28 and therefore control the recovery system(s) to which the interceptors 30 of the various catch basins 10' are connected.

OPERATION

When the system of FIG. 1 has been modified to that of FIG. 2 by the installation of interceptors 30 (as shown in FIG. 3) in each of the catch basins 10' and the installation of the recovery system and the connections thereto, operation would be as follows: valves 44 and 48 which are in branches 50 and 54 and are connected to the recovery tanks 22 and 24, respectively, would normally be closed and the valve 46 in branch 52 would be normally open. During periods of light rain, water entering the catch basin 10' would enter the interceptor 30 and flow through the open valve 46 to be discharged into the catch basin 10' and into storm sewer 12. In heavy rain the interceptor 30 would not be able to handle all of the water reaching the periphery of the catch basin 10'. Excess water would overflow the inner wall 31 of the interceptor 30 and enter the catch basin 10' and flow into storm sewer 12. Thus no significant restriction to normal flow into the catch basin 10' is presented by installation of the interceptor 30. When flow to the catch basin 10' stops, all water in the interceptor 30 will drain down the sloping trough through the open valve 46 and branch 52 into the catch basin 10' and storm sewer 12 to prevent the accumulation of stagnant water.

If a spill occurs in the region drained by one or more of the catch basins 10' the valves 46 which are normally open are immediately closed and valve 44 and/or 48 which are normally closed are immediately opened to permit flow to recovery tank 22 and/or 24. This procedure will be done manually for all valves in the affected area. The spilled material, e.g. fuel oil or any other pollutant, drains into the recovery tank 22 and/or 24 where it would be stored for recycling or safe disposition at a later time.

The present invention has been described in terms of intercepting liquid pollutants and directing them to an appropriate recovery system. It would be useful for numerous other applications of an industrial nature in which it is desirable to intercept liquids flowing into sumps and/or for directing these liquids to selected locations without interfering significantly with the acceptance rate of the sump for overflow liquids. If it is used at a location where spills of different materials are likely to occur it could be equipped with drains of three or more branches so that different materials could be recovered in different tanks to permit safer and less expensive ultimate disposition.

Another potential use for this invention is for intercepting the initial storm runoff from drainage areas such as city streets, parking lots, highways, etc. It is known that the initial runoff from such areas contains higher concentrations of pollutants than runoff which occurs at later stages in the storm, and that it would be desirable in some cases to intercept the initial runoff and divert it to a treatment system. It is impractical in most cases to divert all storm runoff to a treatment system because in persistant heavy rain the treatment system is overloaded and even normal waste water is flushed in almost raw form into receiving waters.

By the use of trough interceptors in the catch basins and the adjustment of the acceptance rate of the interceptor drain it is possible to limit the amount of water diverted to the treatment system to that amount which can be safely handled by the treatment system. By installation of a surge or retention tank between the interceptor and the device used to adjust acceptance rate of the drain (e.g. a valve) it is assured that the initial runoff is always accepted into the treatment system.

The catch basin trough interceptor can be constructed of fiberglass, metal or plastic. For specific installations, it is desirable to select construction materials which do not react chemically with materials that are expected to be used in the vicinity. When constructed of fiberglass and plastics, it may be desirable to place a metal gasket between the lip of the trough and the grill of the catch basin so that mechanical loads are distributed more uniformly over the lip of the trough. The gasket material between the lip of the trough and the ledge of the catch basin should be selected to be nonreactive with materials used in the vicinity and to provide a good seal at this location. Where the ledge structure does not extend around the entire periphery, a sealant may be used to seal the trough-catch basin interface.

Although a preferred embodiment of the present invention has been described, other changes will occur to those skilled in the art. For example, the number of branches may be changed, the valves may be automated to: (1) open and close in response to the sensing of a specific material by a sensor; (2) to sequentially fill each of the retention-treatment systems before diverting the flow to the storm sewer; and/or (3) to obviate the need for a workman to be exposed to hazardous spills. It is therefore intended that the scope of the present invention is to be limited only by the scope of the appended claims.

We claim:

1. In a catch basin having ledge structure on at least two opposing sides, a grate seating on said ledge structure and connected to a storm sewer, the improvement including:

an open, sloping trough for installation on said ledge structure and around the inner periphery of said catch basin;

an outlet pipe in fluid communication with said trough at a point proximating the lowest portion of said trough;

a receiver system;

a line connecting said outlet pipe with said receiver system;

a valve in said line, whereby when said valve is open, runoff water and spills flowing into said catch basin are intercepted by said trough and flow through said outlet pipe into said receiver system, and flow into said storm sewer only when said trough overflows.

2. The improvement of claim 1 further including:

a second receiver system;

a second line connecting said outlet pipe with said second receiver system;

a second valve in said second line whereby runoff water and spills can be selectively diverted to either of said receiver systems.

3. The improvement of claim 2 further including:

a third line connecting said outlet pipe with said catch basin; and a third valve in said third line whereby flow into said trough can be directed into said storm sewer.

4. The improvement of claim 1 wherein said trough has a peripheral lip for seating on said ledge structure and for being held in place by said grill.

5. A system for reducing the amount of pollutants entering a storm sewer including:

a storm sewer system;

a plurality of catch basins operatively connected to said storm sewer system and each having ledge structure on at least two opposing sides and a grate adapted to seat on said ledge structure;

a receiver system;

each catch basin having:

(a) an open, sloping trough having an outlet proximating the lowest point of the trough and a peripheral lip adapted to seat on the ledge structure of the catch basin and to be held in place by the grate;

(b) a fluid line connecting said outlet to said receiver system; and (c) a valve in the fluid line intermediate the outlet and the receiver system, whereby when the valve is open, runoff water and spills flowing into the catch basin are intercepted by the trough and flow through the outlet into said receiver system, and flow into said storm sewer only when said trough overflows.

6. The system of claim 5 further including:

a second receiver system; and at least one catch basin having:

(a) a second fluid line connecting said outlet to said second receiver system; and (b) a second valve in the second fluid line intermediate the outlet and the second receiver system, whereby runoff water and spills flowing into the catch basin are intercepted by the trough and selectively diverted to either the first or second receiver system.

7. The system of claim 6 each catch basin further including:

(a) a third fluid line connecting said outlet to said catch basin; and (b) a third valve in said third fluid line whereby flow into said trough can be directed into said storm sewer.

* * * * *